US010431934B2

(12) United States Patent
Toda et al.

(10) Patent No.: US 10,431,934 B2
(45) Date of Patent: Oct. 1, 2019

(54) CONNECTOR

(71) Applicant: Japan Aviation Electronics Industry, Limited, Tokyo (JP)

(72) Inventors: Kentaro Toda, Tokyo (JP); Masamichi Sasaki, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/027,571

(22) Filed: Jul. 5, 2018

(65) Prior Publication Data

US 2019/0089095 A1 Mar. 21, 2019

(30) Foreign Application Priority Data

Sep. 21, 2017 (JP) ..... 2017-181506

(51) Int. Cl.
*H01R 13/6461* (2011.01)
*H01R 13/26* (2006.01)
(Continued)

(52) U.S. Cl.
CPC ..... *H01R 13/6461* (2013.01); *H01R 13/26* (2013.01); *H01R 13/6474* (2013.01);
(Continued)

(58) Field of Classification Search
CPC ..... H01R 13/6461; H01R 13/26; H01R 13/6474; H01R 13/6585; H01R 12/7064; H01R 12/707
(Continued)

(56) References Cited

U.S. PATENT DOCUMENTS 8,333,619 B2 12/2012 Kondo et al.
8,376,783 B2 2/2013 Kondo et al.
(Continued)

FOREIGN PATENT DOCUMENTS

CN 104852199 A 8/2015
JP H07-161414 A 6/1995
(Continued)

OTHER PUBLICATIONS

Japanese Office Action dated Aug. 22, 2018 in Japanese Application No. 2017-181506 with English Translation.
(Continued)

*Primary Examiner* — Edwin A. Leon
(74) *Attorney, Agent, or Firm* — Collard & Roe, P.C.

(57) ABSTRACT

A connector includes signal contacts and predetermined contacts maintained at predetermined voltage levels. Each contact has a horizontal portion, an intersecting portion extending along a direction intersecting with the horizontal portion and a coupling portion coupling the horizontal portion and the intersecting portion to each other. The contacts include a first contact group made up of the two predetermined contacts and one differential pair of the two signal contacts. In the first contact group, a size of the coupling portion of each of the predetermined contacts in the pitch direction is larger than another size of the coupling portion of each of the signal contacts in the pitch direction, and a size of the intersecting portion of each of the predetermined contacts in the pitch direction is larger than another size of the intersecting portion of each of the signal contacts in the pitch direction.

12 Claims, 8 Drawing Sheets

(51) Int. Cl.

| | |
|---|---|
| ***H01R 13/6474*** | (2011.01) |
| *H01R 12/70* | (2011.01) |
| *H01R 13/6585* | (2011.01) |
| *H01R 12/72* | (2011.01) |
| *H01R 24/60* | (2011.01) |

(52) U.S. Cl.
CPC ..... *H01R 12/707* (2013.01); *H01R 12/7064* (2013.01); *H01R 12/724* (2013.01); *H01R 13/6585* (2013.01); *H01R 24/60* (2013.01)

(58) Field of Classification Search
USPC ..... 439/78
See application file for complete search history.

(56) References Cited

U.S. PATENT DOCUMENTS

| | | | | |
|---|---|---|---|---|
| 9,022,800 | B2 * | 5/2015 | Yang | H01R 13/6581 439/487 |
| 9,083,130 | B2 | 7/2015 | Casher et al. | |
| 9,093,792 | B2 | 7/2015 | Shiratori et al. | |
| 9,379,494 | B1 | 6/2016 | Hu et al. | |
| 9,379,499 | B2 | 6/2016 | Miyoshi et al. | |
| 9,647,393 | B2 | 5/2017 | Tsai et al. | |
| 9,722,360 | B2 | 8/2017 | Yao et al. | |
| 2015/0207280 | A1 * | 7/2015 | Little | H01R 24/60 439/607.34 |
| 2015/0229077 | A1 * | 8/2015 | Little | H01R 12/724 439/78 |
| 2015/0270646 | A1 * | 9/2015 | Kao | H01R 13/6581 439/76.1 |
| 2016/0329663 | A1 | 11/2016 | Han et al. | |
| 2017/0047689 | A1 * | 2/2017 | Yao | H01R 13/652 |

FOREIGN PATENT DOCUMENTS

| | | | |
|---|---|---|---|
| JP | 2010-182623 | A | 8/2010 |
| JP | 2011-9151 | A | 1/2011 |
| JP | 2014-157790 | A | 8/2014 |
| JP | 5683610 | B2 | 3/2015 |
| JP | 2016-046074 | A | 4/2016 |

OTHER PUBLICATIONS

English translation of the Taiwanese Office Action in Taiwanese Application No. 107124905, dated Feb. 27, 2019.
Japanese Office Action in JP 2018-193648, dated Jul. 10, 2019, with English translation.

* cited by examiner

CONNECTOR

CROSS REFERENCE TO RELATED APPLICATIONS

This application is based on and claims priority under 35 U.S.C. § 119 to Japanese Patent Application No. JP2017-181506 filed Sep. 21, 2017, the content of which is incorporated herein in its entirety by reference.

BACKGROUND OF THE INVENTION

This invention relates to a connector comprising a differential pair of signal contacts for high-speed signal transmission.

For example, this type of connector is disclosed in JP 2011-9151A (Patent Document 1), the content of which is incorporated herein by reference.

Referring to FIG. 15, Patent Document 1 discloses a connector comprising a housing (not shown) and a plurality of lower terminals (contacts) 90 held by the housing. The contacts 90 include a differential pair of two signal contacts 90S for high-speed signal transmission. Each of the signal contacts 90S has a horizontal portion 92 which is to be in contact with a mating contact (not shown) of a mating connector (not shown) and an intersecting portion 94 which extends in a direction intersecting with the horizontal portion 92 to be fixed to a circuit board (not shown). For each of the signal contacts 90S, the intersecting portion 94 is partially provided with a wide portion 942 which is wider than the horizontal portion 92, so that impedances of the two signal contacts 90S are matched with each other.

However, even in a case where the impedances are matched as disclosed in Patent Document 1, signal degradation such as signal distortion might occur as signal frequency increases. In other words, when a high-frequency signal is transmitted, preferable frequency characteristics cannot be obtained merely by the impedance matching.

SUMMARY OF THE INVENTION

It is therefore an object of the present invention to provide a connector which comprises a differential pair and which comprises contacts having a new structure for obtaining good frequency characteristics.

An aspect of the present invention provides a connector mountable on a circuit board and mateable with a mating connector along a mating direction. The connector comprises a housing and a plurality of contacts which include two or more signal contacts for signal transmission and two or more predetermined contacts maintained at predetermined voltage levels. The housing holds the contacts. Each of the contacts has a horizontal portion extending along the mating direction, an intersecting portion extending along an intersecting direction intersecting with the mating direction, a fixed portion extending from the intersecting portion and fixed to the circuit board when the connector is used, and a coupling portion coupling the horizontal portion and the intersecting portion to each other. The contacts include one or more first contact groups. Each of the first contact groups consists of two of the predetermined contacts and one differential pair of two of the signal contacts. For each of the first contact groups, the contacts are arranged in a pitch direction perpendicular to the mating direction, and the differential pair is located between the predetermined contacts in the pitch direction. For each of the first contact groups, a size of the coupling portion of each of the predetermined contacts in the pitch direction is larger than another size of the coupling portion of each of the signal contacts in the pitch direction, and a size of the intersecting portion of each of the predetermined contacts in the pitch direction is larger than another size of the intersecting portion of each of the signal contacts in the pitch direction.

According to an aspect of the present invention, in the pitch direction, the differential pair of the two signal contacts are located between the two predetermined contacts maintained at the predetermined voltage levels. For example, a power contact and a ground contact interpose the differential pair for high-speed signal transmission therebetween. In particular, the size of the coupling portion of each predetermined contact in the pitch direction is larger than the size of the coupling portion of each signal contact in the pitch direction, and the size of the intersecting portion of each predetermined contact in the pitch direction is larger than the size of the intersecting portion of each signal contact in the pitch direction. In other words, each of the power contact and the ground contact has a wide portion. This wide portion extends from the intersecting portion, which intersects with the horizontal portion, to the coupling portion which couples the horizontal portion and the intersecting portion to each other, so that distortion of transmission signal is reduced. According to an aspect of the present invention, signal degradation such as signal distortion can be suppressed by the aforementioned structure even when signal frequency increases in the signal contact.

An appreciation of the objectives of the present invention and a more complete understanding of its structure may be had by studying the following description of the preferred embodiment and by referring to the accompanying drawings.

Figure 1:
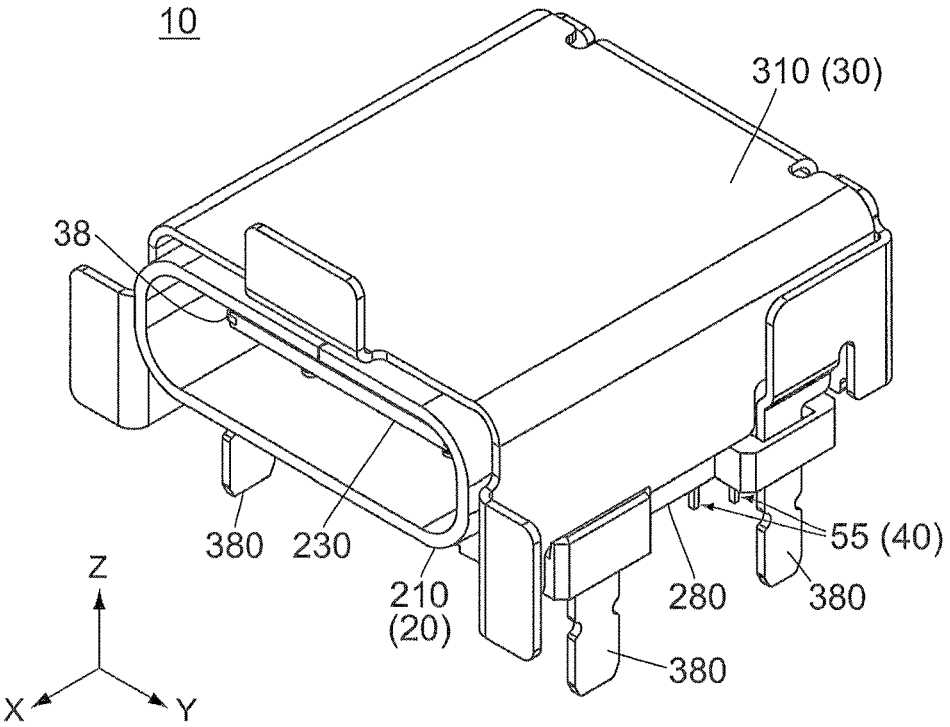
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1, 2, 6 and 7, a connector 10 according to an embodiment of the present invention comprises a housing 20 made of insulator, a shell 30 made of conductor, a mid-plate 38 made of conductor and a plurality of contacts 40 each made of conductor.

Hereafter, explanation will be made about the structure and function of the connector 10 of the present embodiment.

Figure 2:
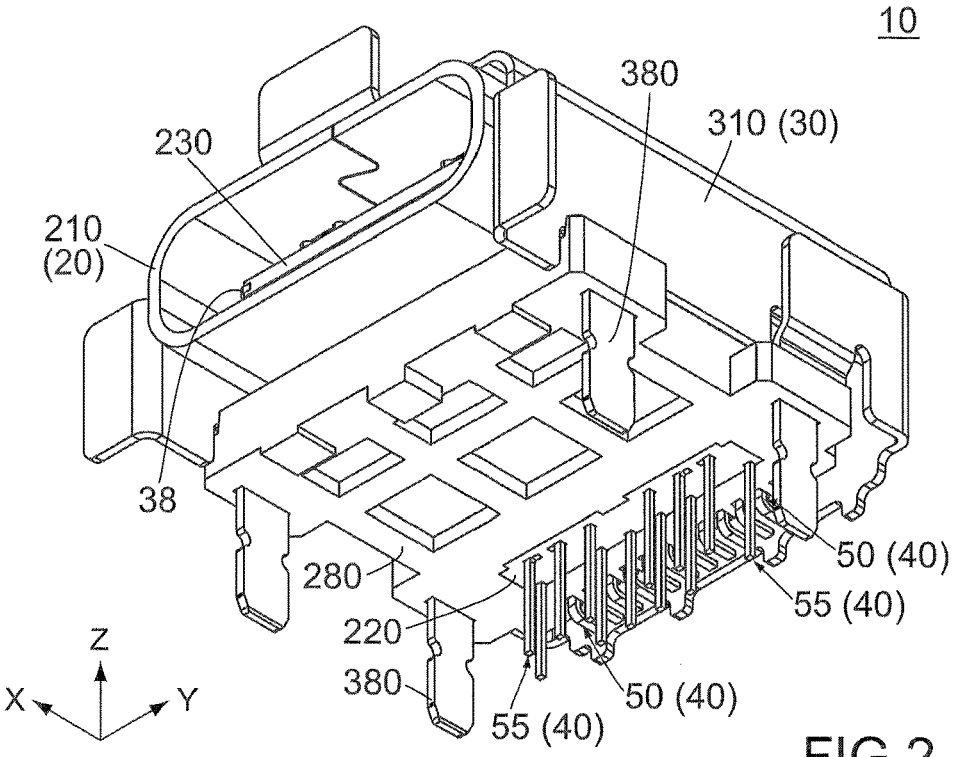
FIG. 2 is another perspective view showing the connector of FIG. 1.
Figure 3:
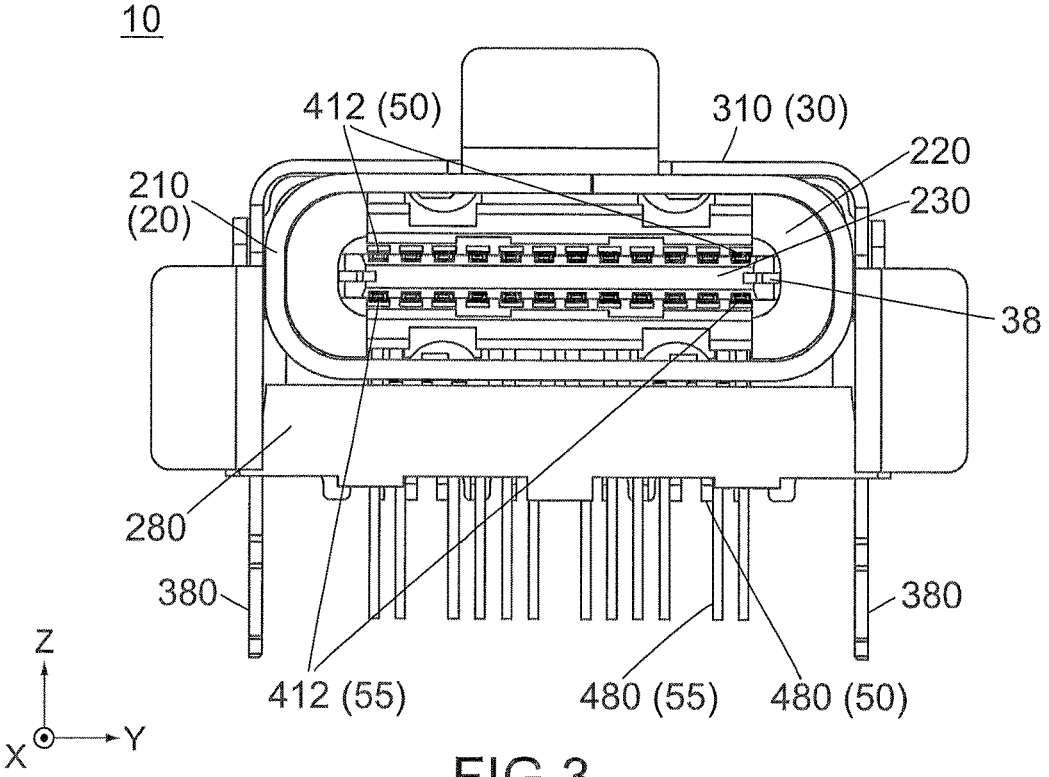
FIG. 3 is a front view showing the connector of FIG. 1.
Figure 4:
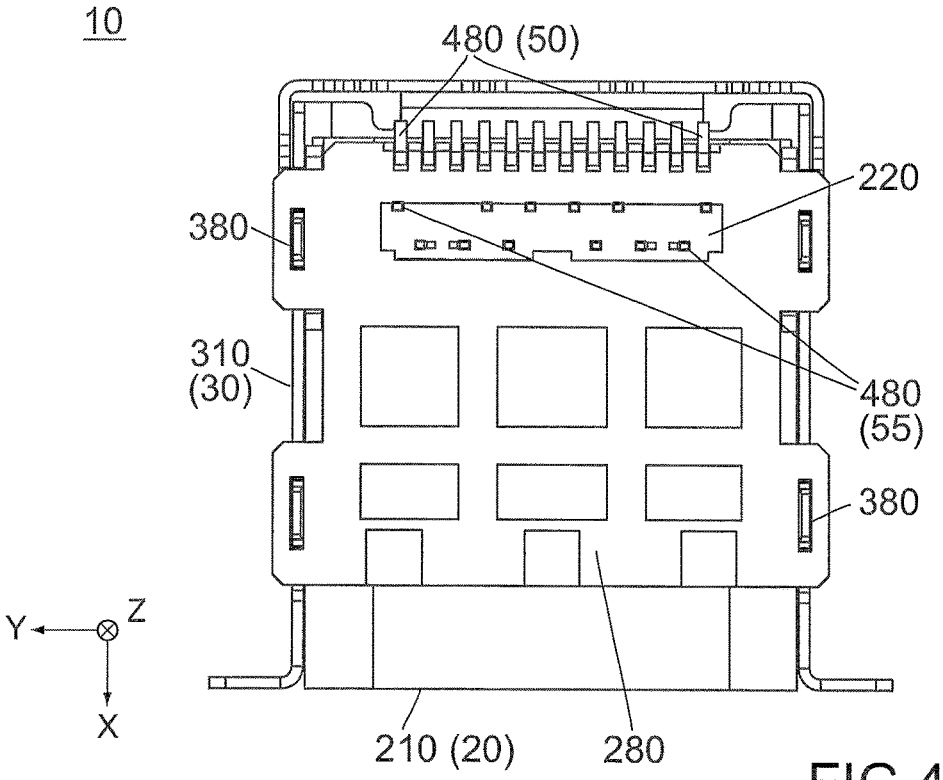
FIG. 4 is a bottom view showing the connector of FIG. 1.
Figure 6:
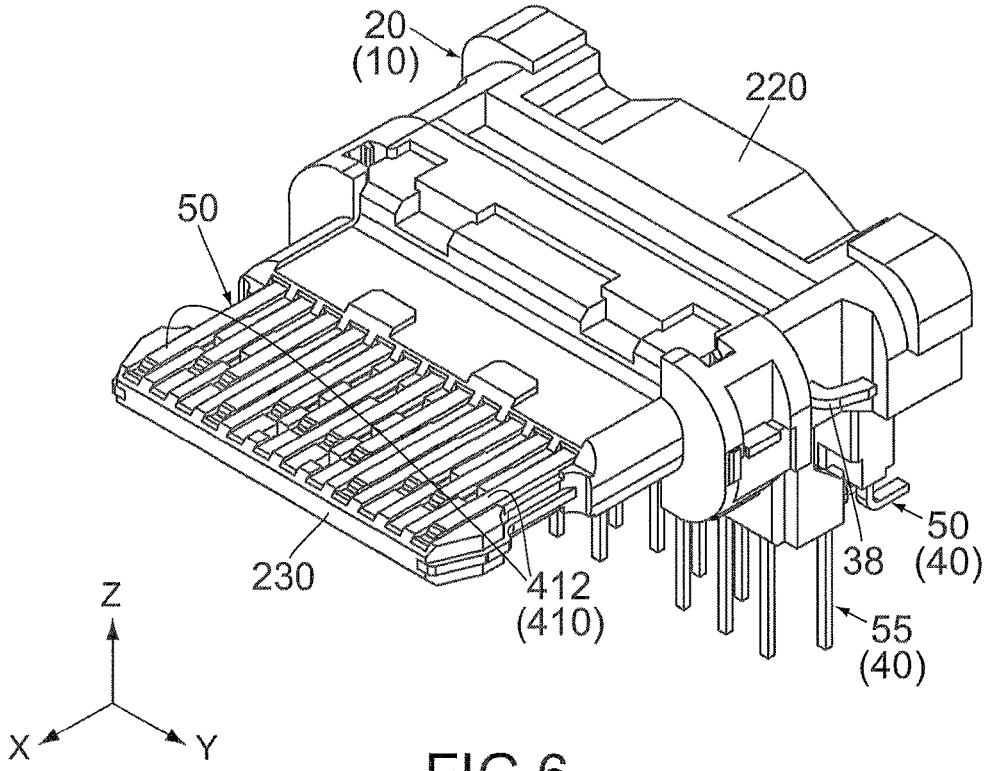
FIG. 6 is a perspective view showing an assembly including a part of a housing, a mid-plate and contacts of the connector of FIG. 1.

Referring to FIGS. 1 to 4 and 6, the housing 20 has a fit portion 210, a base portion 220, a plate-like portion 230 and a bottom portion 280. Referring to FIGS. 1 to 4, the bottom portion 280 is located at a lower end, or the negative Z-side end, of the housing 20 in an upper-lower direction (Z-direction) and extends along a horizontal plane (XY-plane) perpendicular to the Z-direction. The bottom portion 280 holds a lower end of the base portion 220, and the base portion 220, except its lower end, is located above the bottom portion 280. Referring to FIG. 6, the plate-like portion 230 has a flat-plate shape in parallel to the XY-plane as a whole and extends forward, or in the positive X-direction, from the base portion 220 along a front-rear direction (X-direction). Referring to FIGS. 1 to 3, the fit portion 210 has a tube-like shape and extends forward from the base portion 220 along the X-direction. The fit portion 210 encloses the plate-like portion 230 in a perpendicular plane (YZ-plane).

Referring to FIGS. 1 to 4, the shell 30 is a single metal plate with bends and has a body portion 310 and four legs 380. The body portion 310 covers an upper surface (positive Z-side surface), opposite side surfaces in a pitch direction (Y-direction) and a rear surface (negative X-side surface) of the housing 20. The legs 380 extend downward, or in the negative Z-direction, from the body portion 310.

Figure 5:
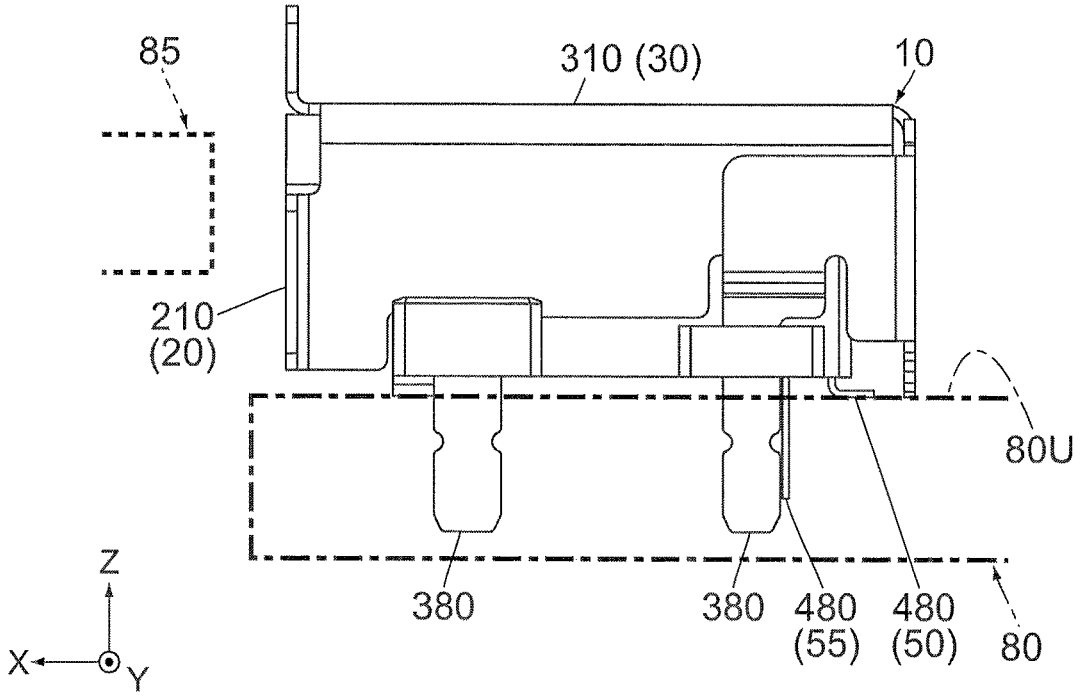
FIG. 5 is a side view showing the connector of FIG. 1, wherein dashed line shows an outline of a mating connector mateable with the connector, and chain dotted line shows an outline of a circuit board on which the connector is mounted.

Referring to FIG. 5, the connector 10 is mountable on a circuit board 80 which is, for example, installed in an electronic device (not shown) when used. Thus, the connector 10 is an on-board connector. In particular, the connector 10 according to the present embodiment is mounted on an upper surface 80U of the circuit board 80 in the Z-direction when used. However, the present invention is not limited thereto. For example, the connector 10 may be partially inserted into a hole or a recess formed on the circuit board 80 when used.

The connector 10 is a receptacle and is mateable with a plug, namely a mating connector 85, along a mating direction (X-direction: front-rear direction). Under a mated state where the connector 10 and the mating connector 85 are mated with each other, a mating fit portion (see dashed line in FIG. 5) of the mating connector 85 is inserted into the fit portion 210 of the connector 10.

The housing 20 and the shell 30 of the present embodiment form the aforementioned structure. However, the structure of the housing 20 and the shell 30 is not limited thereto, provide that the housing 20 and the shell 30 form the on-board connector 10 mateable with the mating connector 85. Moreover, the connector 10 does not need to comprise the shell 30.

Figure 11:
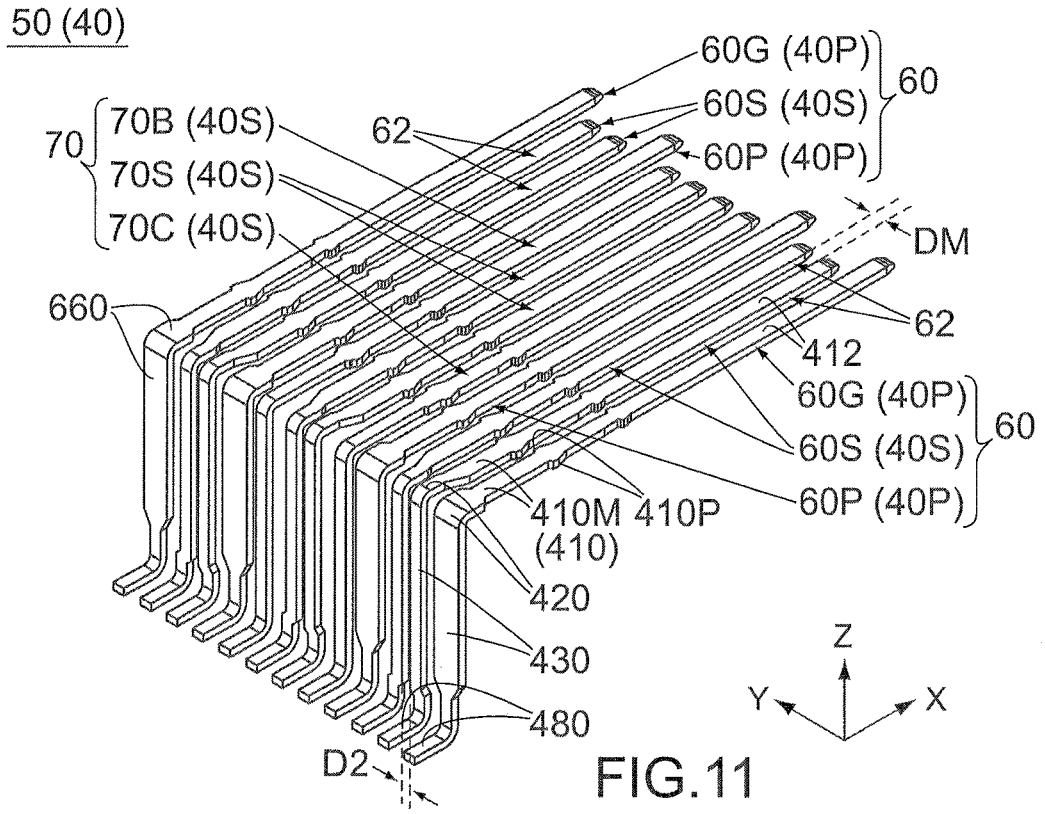
FIG. 11 is a perspective view showing the upper contacts of FIG. 7.
Figure 12:
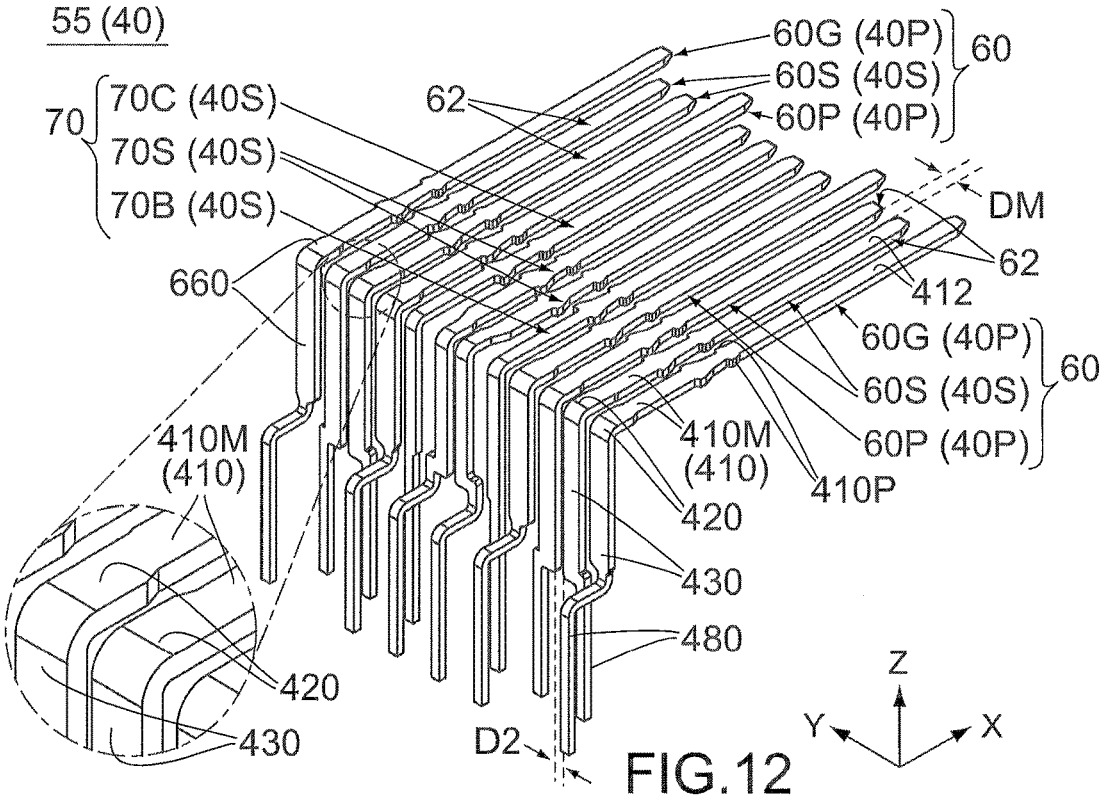
FIG. 12 is a perspective view showing the lower contacts of FIG. 7, wherein parts of the lower contacts enclosed by chain dotted line are enlarged to be illustrated.

Referring to FIGS. 2 and 6, the contacts 40 in the present embodiment include a plurality of upper contacts 50 and a plurality of lower contacts 55. As shown in FIG. 11, the upper contacts 50 are arranged in a straight line in the Y-direction so that a row of the upper contacts 50, namely an upper row, is formed. As shown in FIG. 12, the lower contacts 55 are arranged in a straight line in the Y-direction so that a row of the lower contacts 55, namely a lower row, is formed.

Figure 7:
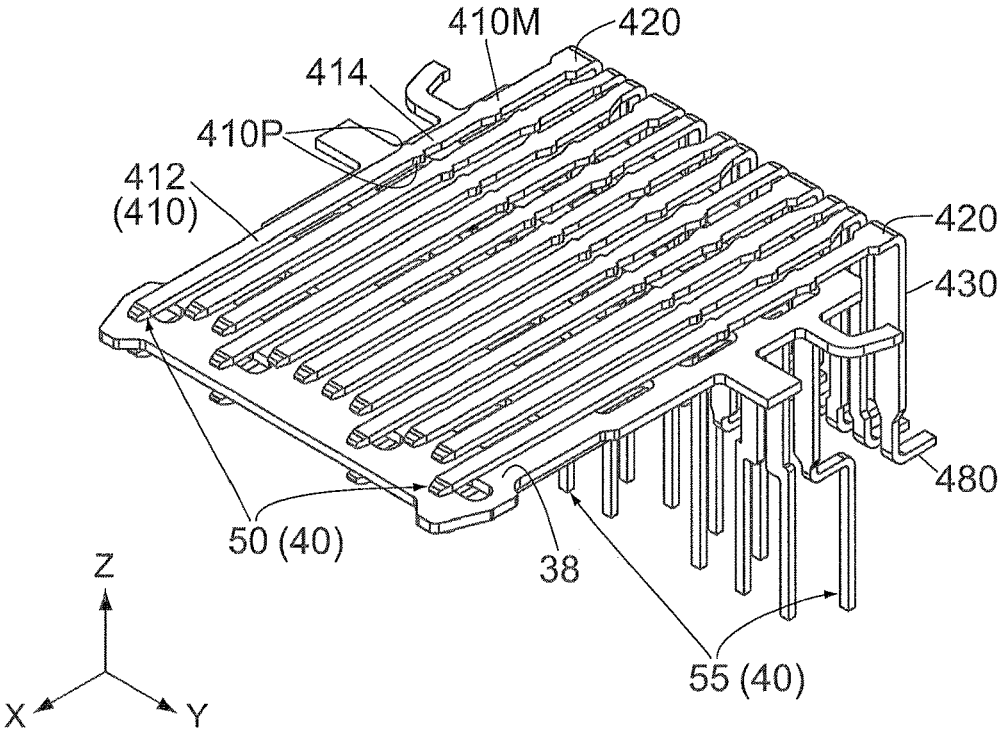
FIG. 7 is a perspective view showing the mid-plate and the contacts of the assembly of FIG. 6.
Figure 8:
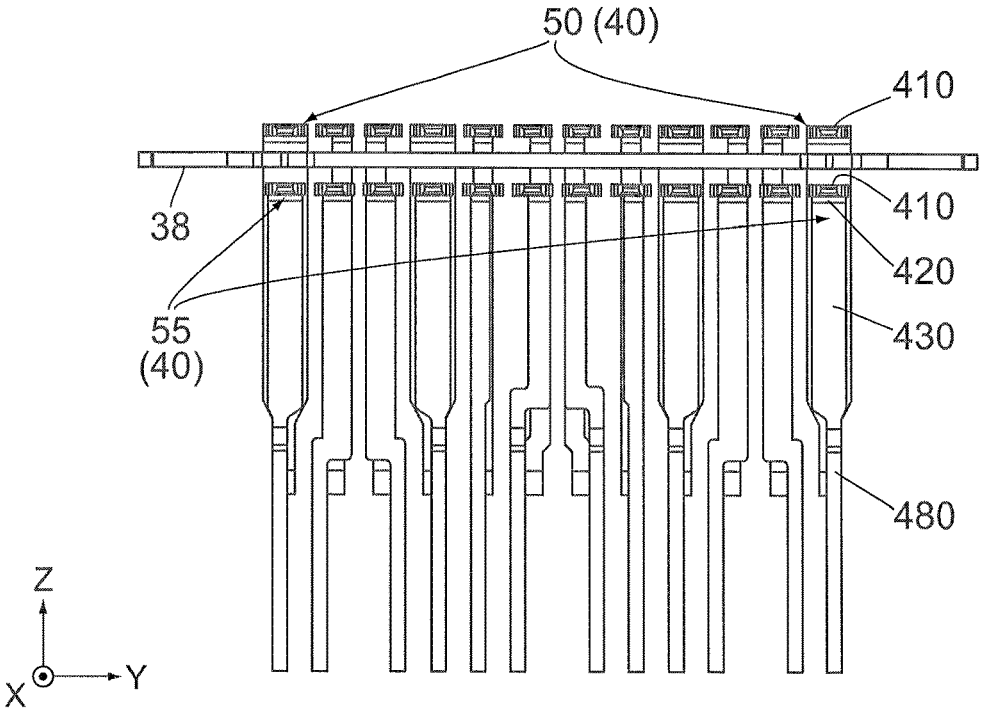
FIG. 8 is a front view showing the mid-plate and the contacts of FIG. 7.

Referring to FIGS. 7 and 8, a position of the upper row of the upper contacts 50 in a vertical plane (XZ-plane) and another position of the lower row of the lower contacts 55 in the XZ-plane are different from each other. Thus, the contacts 40 in the present embodiment are separated into two rows of the upper row and the lower row which are located at positions different from each other in the XZ-plane. However, the present invention is not limited thereto. For example, the contacts 40 may only form the upper row. In other words, all of the contacts 40 may be the upper contacts 50. Instead, the contacts 40 may include another row of the contacts 40 in addition to the upper contacts 50 and the lower contacts 55.

Referring to FIGS. 11 and 12, in the present embodiment, the upper contacts 50 are formed of twelve of the contacts 40, and the lower contacts 55 are formed of remaining twelve of the contacts 40. However, the number of the upper contacts 50 and the number of the lower contacts 55 according to the present invention are not limited thereto. Moreover, the number of the upper contacts 50 may be different from the number of the lower contacts 55.

As shown in FIGS. 11 and 12, the upper contacts 50 and the lower contacts 55 of the contacts 40 have shapes and sizes slightly different from one another. However, all of the contacts 40 have basic structures same as one another. More specifically, each of the contacts 40 has a horizontal portion 410, a coupling portion 420, an intersecting portion 430 and a fixed portion 480. The horizontal portion 410 extends along the X-direction. The intersecting portion 430 extends along an intersecting direction intersecting with the X-direction. The coupling portion 420 extends in the XZ-plane with bends and couples the horizontal portion 410 and the intersecting portion 430 to each other. The fixed portion 480 extends downward from the intersecting portion 430 as a whole.

In the present embodiment, the connector 10 (see FIG. 5) is a right-angle connector, and the intersecting direction along which the intersecting portions 430 extend is the Z-direction perpendicular to the X-direction. Thus, for each of the contacts 40, the horizontal portion 410 and the intersecting portion 430 extend in directions perpendicular to each other. In other words, the intersection angle between the horizontal portion 410 and the intersecting portion 430 is 90 degrees. However, the present invention is not limited thereto. The intersection angle between the horizontal portion 410 and the intersecting portion 430 may be less than or more than 90 degrees. In other words, the intersecting portion 430 may extend along a direction oblique to the X-direction. However, from a view point of reduction of a mounting area of the connector 10 (see FIG. 5) on the circuit board 80 (see FIG. 5), the intersecting portion 430 is preferred to extend along the Z-direction perpendicular to the mating direction (X-direction) within a tolerance range.

Figure 9:
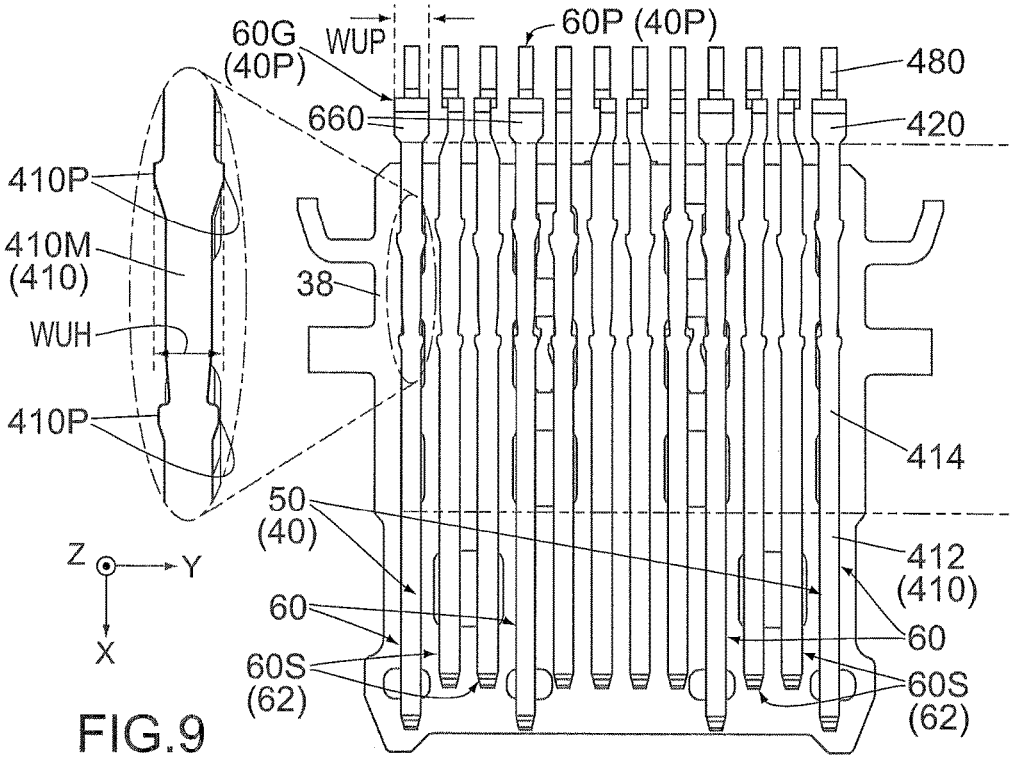
FIG. 9 is a top view showing the mid-plate and the contacts of FIG. 7, wherein a part of an upper contact enclosed by chain dotted line is enlarged to be illustrated, and a boundary between contact portions and held portions of the upper contacts and another boundary between the held portions and coupling portions of the upper contacts are illustrated in two-dot chain line.
Figure 10:
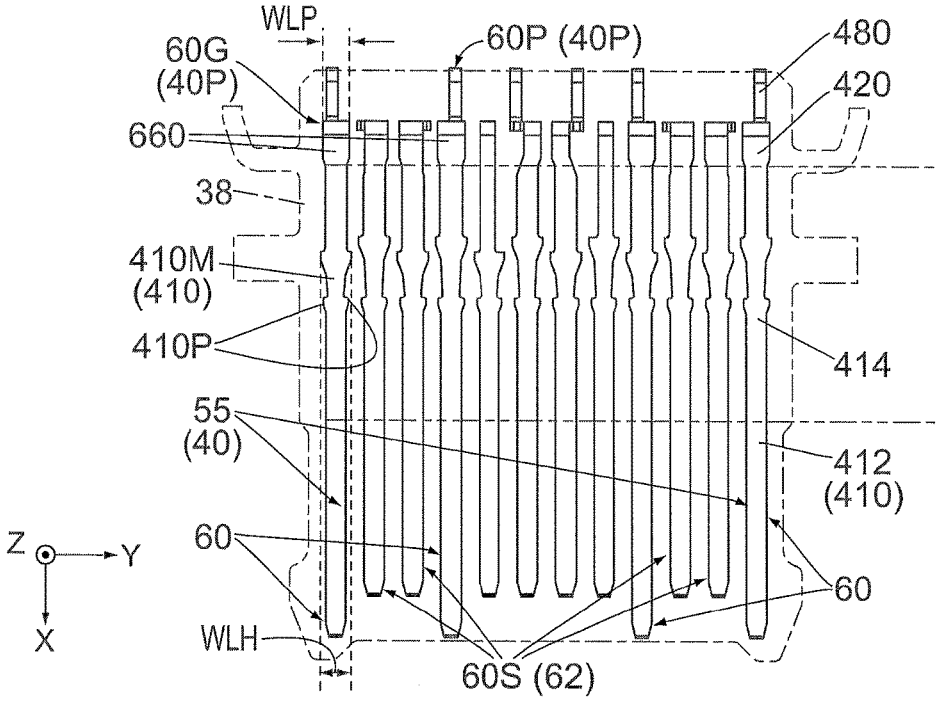
FIG. 10 is a top view showing lower contacts hidden under the mid-plate of FIG. 9, wherein an outline of the mid-plate is illustrated in dashed line, and a boundary between contact portions and held portions of the lower contacts and another boundary between the held portions and coupling portions of the lower contacts are illustrated in two-dot chain line.

As shown in FIGS. 9 and 10, for each of the upper contacts 50 and the lower contacts 55, the horizontal portion 410 extends forward, or in the positive X-direction, from a front end, or the positive X-side end, of the coupling portion 420 to have a main portion 410M and a plurality of press-fit portions 410P. The main portion 410M linearly extends between a front end and a rear end (negative X-side end) of the horizontal portion 410 along the X-direction. Each of the press-fit portions 410P projects outward from the main portion 410M in the Y-direction. The number of the press-fit portions 410P in the present embodiment is four. However, the number of the press-fit portions 410P in the present invention is not limited to four. Moreover, the press-fit portions 410P may be provided as necessary.

For each of the upper contacts 50 and the lower contacts 55, the horizontal portion 410 has a contact portion 412 and a held portion 414. The held portion 414 extends forward from the front end of the coupling portion 420. The press-fit portions 410P are provided on the held portion 414. The contact portion 412 extends forward from a front end of the held portion 414.

Referring to FIG. 6 together with FIGS. 9 and 10, for each of the upper contacts 50 and the lower contacts 55, the held portion 414 is press-fit into and held by the base portion 220 of the housing 20. Thus, the housing 20 holds the contacts 40. As described above, in the present embodiment, each of the contacts 40 is press-fit into the housing 20. However, the present invention is not limited thereto. For example, each of the contacts 40 may be insert-molded in the housing 20.

For each of the upper contacts 50 and the lower contacts 55, the contact portion 412 extends forward from the base portion 220 through the inside of a groove formed on the plate-like portion 230. Referring to FIG. 3, the contact portions 412 of the upper contacts 50 are located on an upper surface of the plate-like portion 230 and arranged at regular interval in the Y-direction. The contact portions 412 of the lower contacts 55 are located on a lower surface, or the negative Z-side surface, of the plate-like portion 230 and arranged at regular interval in the Y-direction. Each of the contact portions 412 is brought into contact with a corresponding mating contact (not shown) of the mating connector 85 (see FIG. 5) under the mated state of the connector 10.

Figure 13:
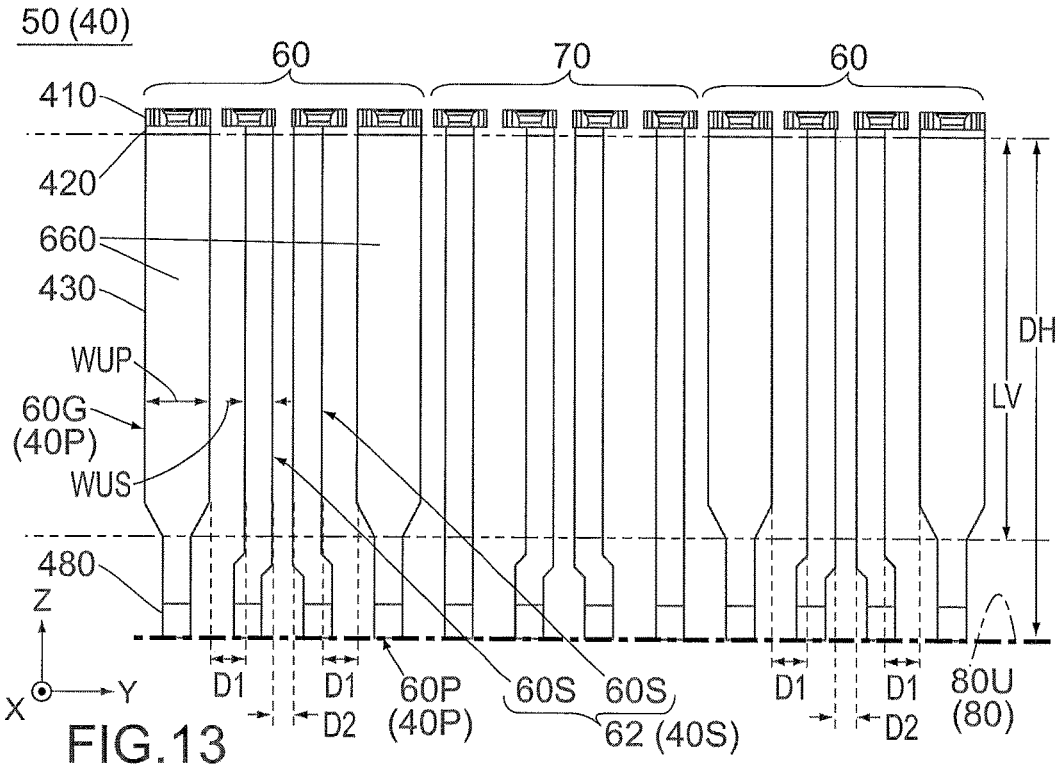
FIG. 13 is a front view showing the upper contacts of FIG. 11, wherein a position of an upper surface of the circuit board is illustrated in chain dotted line, and a boundary between the coupling portions and intersecting portions of the upper contacts and another boundary between the intersecting portions and fixed portions of the upper contacts are illustrated in two-dot chain line.
Figure 14:
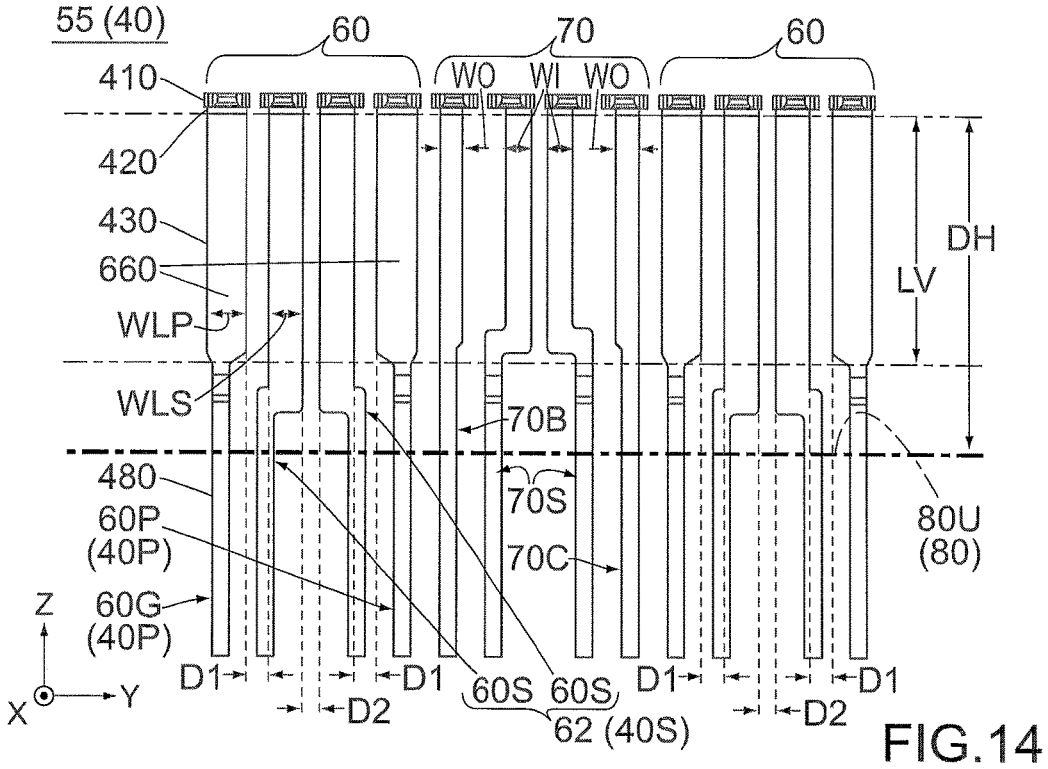
FIG. 14 is a front view showing the lower contacts of FIG. 12, wherein a position of the upper surface of the circuit board is illustrated in chain dotted line, and a boundary between the coupling portions and intersecting portions of the lower contacts and another boundary between the intersecting portions and fixed portions of the lower contacts are illustrated in two-dot chain line.
Figure 15:
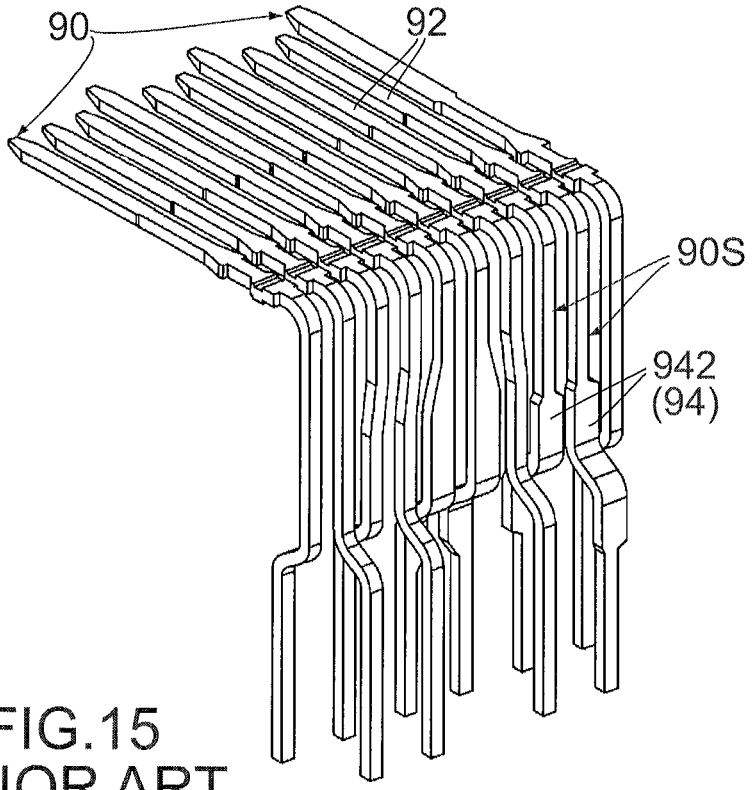
FIG.15 PRIOR ART
FIG. 15 is a perspective view showing lower terminals of a connector of Patent Document 1.

As shown in FIGS. 13 and 14, for each of the upper contacts 50 and the lower contacts 55, the intersecting portion 430 extends downward from a lower end of the coupling portion 420. Referring to FIG. 13 together with FIG. 11, for each of the upper contacts 50, the fixed portion 480 extends downward from a lower end of the intersecting portion 430 and subsequently extends rearward. Referring to FIG. 14 together with FIG. 12, for each of the six lower contacts 55, the fixed portion 480 extends rearward from a lower end of the intersecting portion 430 and subsequently extends downward. For each of the remaining six lower contacts 55, the fixed portion 480 roughly extends downward.

Referring to FIGS. 5, 11 and 12, for each of the upper contacts 50 and the lower contacts 55, the fixed portion 480 is fixed to the circuit board 80 via soldering, etc. and connected to a conductive pattern (not shown) when the connector 10 is used. In detail, the fixed portions 480 of the upper contacts 50 are to be fixed to the upper surface 80U of the circuit board 80, and the fixed portions 480 of the lower contacts 55 are to be inserted into and fixed to through-holes (not shown) formed in the circuit board 80. Thus, the fixed portions 480 of the contacts 40 are fixed to the circuit board 80 via surface mount technology (SMT) or through hole technology (THT) when the connector 10 is used.

According to the present embodiment, each of the upper contacts 50 is an SMT contact, and each of the lower contacts 55 is a THT contact. As described above, the fixed portions 480 of the lower contacts 55 are separated into two rows in the X-direction so as to keep distance from one another in the XY-plane. Therefore, even when a pitch, or a distance in the Y-direction, between the horizontal portions 410 of the lower contacts 55 adjacent to each other is short, the circuit board 80 can be easily formed with the through-holes. However, the present invention is not limited thereto, but various modifications can be made to the arrangement of the fixed portions 480 of the contacts 40 and the fixing method thereof to the circuit board 80.

Referring to FIGS. 11 and 12, the contacts 40 include a plurality of signal contacts 40S and a plurality of predetermined contacts 40P. When the connector 10 (see FIG. 5) is used, each of the signal contacts 40S is connected to a signal line (not shown) of the circuit board 80 (see FIG. 5) to transmit various kinds of signals. When the connector 10 is used, each of the predetermined contacts 40P is connected to a power line (not shown) or a ground line (not shown) of the circuit board 80 to be maintained at a predetermined constant voltage (predetermined voltage level) such as a power voltage or a ground voltage. Thus, the contacts 40 include two or more of the signal contacts 40S for signal transmission and two or more of the predetermined contacts 40P maintained at predetermined voltage levels.

Referring to FIGS. 7 to 9, according to the present embodiment, the mid-plate 38 has a flat-plate shape which extends along the XY-plane. The mid-plate 38 is formed with a plurality of holes. However, the present invention is not limited thereto, but the structure of the mid-plate 38 can be modified variously.

Referring to FIG. 6, the mid-plate 38 is held by the base portion 220 and the plate-like portion 230 of the housing 20. Referring to FIGS. 3 and 6, the mid-plate 38 extends between a front end of the plate-like portion 230 and the vicinity of a rear end of the base portion 220 in the X-direction, and extends between opposite sides of the plate-like portion 230 in the Y-direction. Referring to FIG. 5, the legs 380 of the shell 30 are fixed and grounded to the circuit board 80 via soldering, etc. when the connector 10 is used. Referring to FIG. 6, the mid-plate 38 is in contact with the shell 30 (not shown) and maintained at the ground voltage of the shell 30 when the connector 10 is used.

Referring to FIGS. 7 to 9, the horizontal portions 410 of the upper contacts 50 are located above the horizontal portions 410 of the lower contacts 55 in the Z-direction. The mid-plate 38 is located between the horizontal portions 410 of the upper contacts 50 and the horizontal portions 410 of the lower contacts 55 in the Z-direction. In detail, for each of the upper contacts 50, the most of the horizontal portion 410 is located right above the mid-plate 38, and for each of the lower contacts 55, almost all parts including the horizontal portion 410 are located right below the mid-plate 38. According to the present embodiment, the mid-plate 38 suppresses electromagnetic coupling between the horizontal portion 410 of each of the upper contacts 50 and the horizontal portion 410 of each of the lower contacts 55. However, the present invention is not limited thereto, but the mid-plate 38 may be provided as necessary.

Hereafter, further explanation will be made about the structure and function of the contacts 40 of the present embodiment.

Referring to FIG. 3, the connector 10 in the present embodiment is a receptacle of universal serial bus (USB) 3.1 TYPE-C, and the structure of the contacts 40 is compliant with this standard as described below.

As shown in FIGS. 11 and 12, the contacts 40 include four first contact groups 60 and two second contact groups 70. In the upper contacts 50 and in the lower contacts 55, the second contact group 70 is located between two of the first contact groups 60 in the Y-direction. Each of the first contact groups 60 consists of two of the predetermined contacts 40P and one differential pair 62 of two of the signal contacts 40S (pair of contacts 40 for differential transmission), and each of the second contact groups 70 consists of four of the signal contacts 40S.

For each of the first contact groups 60, the differential pair 62 of the two signal contacts 40S and the two predetermined contacts 40P are arranged in the Y-direction, and the differential pair 62 is located between the predetermined contacts 40P in the Y-direction. For each of the first contact groups 60, the two signal contacts 40S of the differential pair 62 work as two signal contacts 60S for high-speed signal transmission. For each of the first contact groups 60, the outside predetermined contact 40P in the Y-direction works as a ground contact 60G for ground, and the inside predetermined contact 40P in the Y-direction works as a power contact 60P for power supply.

For each of the second contact groups 70, the four signal contacts 40S are arranged in the Y-direction and grouped into two, namely two inner contacts 70S located inward in the Y-direction and two outer contacts 70B and 70C located outward in the Y-direction. For each of the second contact groups 70, each of the inner contacts 70S works as the signal contact 70S for non-high-speed signal transmission. For each of the second contact groups 70, one of the outer contacts 70B and 70C works as the sideband signal contact 70B, and a remaining one of the outer contacts 70B and 70C works as the configuration signal contact 70C.

Referring to FIGS. 11 and 12, the signal contacts 60S of the first contact groups 60 are compliant with USB 3.1 standard, and the inner contacts 70S of the second contact groups 70 are compliant with USB 2.0 standard. However, the present invention is not limited thereto. For example, the connector 10 (see FIG. 3) does not need to be a receptacle of USB 3.1 TYPE-C. In this case, the contacts 40 may consist of one of the first contact groups 60, or may include two or more of the first contact groups 60. Thus, the contacts 40 may include one or more of the first contact groups 60.

Referring to FIGS. 11 and 12, for each of the first contact groups 60, the power contact 60P and the ground contact 60G of the predetermined contacts 40P put the differential pair 62 for high-speed signal transmission therebetween in the Y-direction. Referring to FIGS. 13 and 14, for each of the first contact groups 60, a size of the coupling portion 420 of each of the predetermined contacts 40P in the Y-direction is larger than another size of the coupling portion 420 of each of the signal contacts 40S in the Y-direction, and a size of the intersecting portion 430 of each of the predetermined contacts 40P in the Y-direction is larger than another size of the intersecting portion 430 of each of the signal contacts 40S in the Y-direction. In other words, each of the power contact 60P and the ground contact 60G has a wide portion 660 which has a wide width, or a large size in the Y-direction.

Referring to FIGS. 9, 10, 13 and 14, for each of the predetermined contacts 40P of the first contact groups 60, the wide portion 660 of the present embodiment includes the coupling portion 420 except the vicinity of the front end thereof and the intersecting portion 430 except the vicinity of the lower end thereof, and has a constant size in the Y-direction. Each of the-thus formed wide portions 660 extends from the intersecting portion 430, which intersects with the horizontal portion 410, to the coupling portion 420 which couples the horizontal portion 410 and the intersecting portion 430 to each other, so that distortion of transmission signal (signal distortion) is reduced. According to the present embodiment, signal degradation such as the signal distortion can be suppressed by the aforementioned structure even when signal frequency increases in the signal contacts 40S. As a result, good frequency characteristics can be obtained.

As shown in FIG. 9, according to the present embodiment, when the mid-plate 38 and the upper contacts 50 are seen from above, for each of the contacts 40 of the first contact groups 60 of the upper contacts 50, the horizontal portion 410 covers, at least in part, the mid-plate 38, but the coupling portion 420 does not cover the mid-plate 38 at all. Referring to FIGS. 9 and 13, since the mid-plate 38 is arranged as described above, the signal distortion in the coupling portions 420 and the intersecting portions 430 of the differential pairs 62 of the upper contacts 50 is reduced mainly by the wide portions 660. However, the present invention is not limited thereto. For example, referring to FIG. 7, the mid-plate 38 may be provided with a part that extends downward from a rear end of the mid-plate 38 through the space between the upper contacts 50 and the lower contacts 55 in the X-direction. The signal distortion may be further reduced by the thus-modified mid-plate 38.

Referring to FIG. 10, according to the present embodiment, when the mid-plate 38 and the lower contacts 55 are seen from above, each of the lower contacts 55 is almost completely located under the mid-plate 38. Thus, each of the contacts 40 of the first contact groups 60 of the lower contacts 55 is almost completely covered by the mid-plate 38 from above. The mid-plate 38 arranged as described above contributes to reduce the signal distortion in the differential pairs 62 of the lower contacts 55 to some extent. However, the present invention is not limited thereto, but the arrangement of the lower contacts 55 relative to the mid-plate 38 may be changed as necessary.

Referring to FIGS. 9 and 13, according to the present embodiment, for each of the predetermined contacts 40P of the upper contacts 50, the wide portion 660 has a size (width WUP) in the Y-direction which is larger than another size (width WUH) of the horizontal portion 410 including the press-fit portions 410P in the Y-direction. In contrast, referring to FIGS. 10 and 14, for each of the predetermined contacts 40P of the lower contacts 55, the wide portion 660 has a size (width WLP) in the Y-direction which is smaller than another size (width WLH) of the horizontal portion 410 including the press-fit portions 410P in the Y-direction. Therefore, each of the wide portions 660 of the present embodiment is particularly effective in reduction of the signal distortion in the upper contacts 50. However, the present invention is not limited thereto. For example, for each of the predetermined contacts 40P of the lower contacts 55, the width WLP may be wider than the width WLH.

Referring to FIGS. 9 to 12, according to the present embodiment, for each of the predetermined contacts 40P of the first contact groups 60, the horizontal portion 410 has the main portion 410M and the press-fit portions 410P, and the size of the intersecting portion 430 in the Y-direction is larger than a size of the main portion 410M in the Y-direction. In other words, a part including the coupling portion 420 and the intersecting portion 430 is made larger than the main portion 410M in the Y-direction. According to this structure, the wide portions 660 can be formed while a size of each of the contact portions 412 in the Y-direction and a distance (pitch) between the contact portions 412 adjacent to each other in the Y-direction are made compliant with the standard such as USB 3.1 standard. However, the present invention is not limited thereto. For example, in the absence of restrictions such as standard, the main portions 410M may be formed wide similar to the intersecting portions 430.

Referring to FIGS. 13 and 14, according to the present embodiment, the wide portion 660 of each of the predetermined contacts 40P is formed to extend as long as possible. More specifically, when the connector 10 (see FIG. 5) is mounted on the circuit board 80, for each of the contacts 40 including the predetermined contacts 40P, a size LV of the intersecting portion 430 in the intersecting direction (Z-direction in the present embodiment) is not less than two-thirds of a distance DH between the lower end of the coupling portion 420 and the upper surface 80U of the circuit board 80 in the intersecting direction. In detail, the size LV of each of the upper contacts 50, which can be relatively easily made large, is not less than three-fourths of the distance DH, and the size LV of each of the lower contacts 55 is not less than two-thirds of the distance DH. As the size LV is made larger, the signal distortion can be more reliably reduced. However, the present invention is not limited thereto, but the size LV may be made large as necessary.

Referring to FIGS. 11 and 12, according to the present embodiment, for each of the first contact groups 60, the horizontal portion 410 of each of the signal contacts 40S has the main portion 410M and the press-fit portions 410P, and a distance (pitch D2) between the intersecting portions 430 of the two signal contacts 40S in the Y-direction is shorter than another distance (pitch DM) between the main portions 410M of the two signal contacts 40S in the Y-direction. In other words, the intersecting portions 430 of the signal contacts 60S of the differential pair 62 are formed to be close to each other. According to this structure, the differential signals in the differential pair 62 can be strongly coupled while the contact portions 412 are made compliant with the standard such as USB 3.1 standard. However, the present invention is not limited thereto. For example, in the absence of restrictions such as standard, the horizontal portions 410 of the differential pair 62 may be close to each other similar to the intersecting portions 430.

Referring to FIGS. 11 and 12, according to the present embodiment, in the upper contacts 50 and in the lower contacts 55, the eight contacts 40 of the two first contact groups 60 are arrange in the Y-direction. In addition, for each of the first contact groups 60, a distance (pitch D1) between the intersecting portion 430 of one of the signal contacts 40S and the intersecting portion 430 of the predetermined contact 40P adjacent thereto in the Y-direction is longer than the distance (pitch D2) between the intersecting portions 430 of the two signal contacts 40S in the Y-direction. As a result, the two differential pairs 62 arranged in the Y-direction are as far apart from each other as possible. According to this structure, crosstalk between the differential pairs 62 can be reduced. However, the present invention is not limited thereto, but magnitude relation between the pitch D1 and the pitch D2 may be changed as necessary.

As describe above, in the present embodiment, the upper contacts 50 include the two first contact groups 60 and the one second contact group 70 other than the first contact groups 60, the lower contacts 55 include the two first contact groups 60 and the one second contact group 70 other than the first contact groups 60, and the eight contacts 40 of the two first contact groups 60 are arranged in the Y-direction. However, the present invention is not limited thereto, but the formation of the contacts 40 can be modified variously. For example, the upper contacts 50 may include only one of the first contact groups 60 or may include two or more of the first contact groups 60. Similarly, the lower contacts 55 may include only one of the first contact groups 60 or may include two or more of the first contact groups 60. Moreover, the two first contact groups 60 of the upper contacts 50 may be consecutively arranged in the Y-direction while sharing the power contact 60P, and the two first contact groups 60 of the lower contacts 55 may be consecutively arranged in the Y-direction while sharing the power contact 60P. According to this structure, the seven contacts 40 form the two first contact groups 60.

The upper contacts 50 and the lower contacts 55 according to the present embodiment have the structure and function described below in addition to the structure and function described above. However, the present invention is not limited thereto, but the structure described below can be modified variously as necessary.

Referring to FIGS. 13 and 14, according to the present embodiment, in the Y-direction, the size (width WUP) of the intersecting portion 430 of each of the predetermined contacts 40P of the first contact groups 60 of the upper contacts 50 is larger than the size (width WLP) of the intersecting portion 430 of each of the predetermined contacts 40P of the first contact groups 60 of the lower contacts 55. According to this structure, impedance can be more reliably matched and reflection loss can be reduced for each of the differential pairs 62 of the upper contacts 50.

According to the present embodiment, in the Y-direction, a size (width WUS) of the intersecting portion 430 of each of the signal contacts 40S of the first contact groups 60 of the upper contacts 50 is smaller than another size (width WLS) of the intersecting portion 430 of each of the signal contacts 40S of the first contact groups 60 of the lower contacts 55. According to this structure, a distance between the two differential pairs 62 of the upper contacts 50 can be made large so that transmission loss can be reduced while crosstalk is suppressed.

Referring to FIG. 14, according to the present embodiment, for the four signal contacts 70S, 70B and 70C of the second contact group 70 of the lower contacts 55, a size (width WI) of the intersecting portion 430 of each of the inner contacts 70S in the Y-direction is larger than another size (width WO) of the intersecting portion 430 of each of the outer contacts 70B and 70C in the Y-direction. According to this structure, a distance between the two differential pairs 62 of the lower contacts 55 can be made large so that transmission loss can be reduced while crosstalk is suppressed.

Referring to FIGS. 13 and 14, according to the present embodiment, in the Y-direction, the size (width WUS) of the intersecting portion 430 of each of the eight signal contacts 40S of the upper contacts 50 is equal to the size (width WO) of the intersecting portion 430 of each of the outer contacts 70B and 70C of the second contact group 70 of the lower contacts 55. According to this structure, the distance between the two differential pairs 62 of the lower contacts 55 can be made large so that crosstalk can be suppressed.

The aforementioned various effects were confirmed by examples of the connector 10 (see FIG. 1). Referring to FIG. 13, for the upper contacts 50 of one of the examples, WUP was 0.45 mm, WUS was 0.2 mm, D1 was 0.25 mm, and D2 was 0.15 mm. Referring to FIG. 14, for the lower contacts 55 of the one of the examples, WLP was 0.35 mm, WLS was 0.3 mm, WO was 0.2 mm, WI was 0.22 mm, D1 was 0.2 mm, and D2 was 0.15 mm.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mountable on a circuit board and mateable with a mating connector along a mating direction, wherein:

the connector comprises a housing and a plurality of contacts which include two or more signal contacts for signal transmission and two or more predetermined contacts maintained at predetermined voltage levels;

the housing holds the contacts;

each of the contacts has a horizontal portion extending along the mating direction, an intersecting portion extending along an intersecting direction intersecting with the mating direction, a fixed portion extending from the intersecting portion and fixed to the circuit board when the connector is used, and a coupling portion coupling the horizontal portion and the intersecting portion to each other;

the contacts include one or more first contact groups;

each of the first contact groups consists of two of the predetermined contacts and one differential pair of two of the signal contacts;

for each of the first contact groups, the contacts are arranged in a pitch direction perpendicular to the mating direction, and the differential pair is located between the predetermined contacts in the pitch direction;

for each of the first contact groups, a size of the coupling portion of each of the predetermined contacts in the pitch direction is larger than another size of the coupling portion of each of the signal contacts in the pitch direction, and a size of the intersecting portion of each of the predetermined contacts in the pitch direction is larger than another size of the intersecting portion of each of the signal contacts in the pitch direction; and the horizontal portion of each of the predetermined contacts of each of the first contact groups includes a contact portion which is to be brought into contact with a corresponding one of mating contacts of the mating connector, and for each of the predetermined contacts of each of the first contact groups, a size of the intersecting portion in the pitch direction is larger than another size of the contact portion in the pitch direction.

2. The connector as recited in claim 1, wherein:

for each of the first contact groups, the horizontal portion of each of the predetermined contacts has a main portion extending along the mating direction and a press-fit portion projecting outward from the main portion in the pitch direction; and for each of the predetermined contacts of the first contact groups, the size of the intersecting portion in the pitch direction is larger than another size of the main portion in the pitch direction.

3. The connector as recited in claim 1, wherein for each of the first contact groups, the horizontal portion of each of the signal contacts has a main portion extending along the mating direction and a press-fit portion projecting outward from the main portion in the pitch direction, and a distance between the intersecting portions of the two signal contacts in the pitch direction is shorter than another distance between the main portions of the two signal contacts in the pitch direction.

4. The connector as recited in claim 1, wherein:

the contacts include two or more of the first contact groups;

the contacts of the two or more of the first contact groups are arranged in the pitch direction; and for each of the first contact groups, a distance between the intersecting portion of one of the signal contacts and the intersecting portion of the predetermined contact adjacent thereto in the pitch direction is longer than another distance between the intersecting portions of the two signal contacts in the pitch direction.

5. The connector as recited in claim 1, wherein for each of the contacts, a size of the intersecting portion in the intersecting direction is not less than two-third of a distance between the coupling portion and the circuit board in the intersecting direction when the connector is mounted on the circuit board.

6. The connector as recited in claim 1, wherein:

the connector comprises a mid-plate made of conductor;

the contacts include a plurality of upper contacts arranged in the pitch direction and a plurality of lower contacts arranged in the pitch direction;

the upper contacts include one or more of the first contact groups;

the horizontal portions of the upper contacts are located above the horizontal portions of the lower contacts in an upper lower direction perpendicular to both the mating direction and the pitch direction;

the mid-plate is located between the horizontal portions of the upper contacts and the horizontal portions of the lower contacts in the upper lower direction; and when the mid-plate and the upper contacts are seen from above, for each of the contacts of the first contact groups, the horizontal portion covers, at least in part, the mid-plate, but the coupling portion does not cover the mid-plate at all.

7. The connector as recited in claim 6, wherein:

the lower contacts include one or more of the first contact groups; and in the pitch direction, a size of the intersecting portion of each of the predetermined contacts of the first contact groups of the upper contacts is larger than another size of the intersecting portion of each of the predetermined contacts of the first contact groups of the lower contacts.

8. The connector as recited in claim 6, wherein:

the lower contacts include one or more of the first contact groups; and in the pitch direction, a size of the intersecting portion of each of the signal contacts of the first contact groups of the upper contacts is smaller than another size of the intersecting portion of each of the signal contacts of the first contact groups of the lower contacts.

9. The connector as recited in claim 6, wherein:

the lower contacts include a second contact group other than the first contact groups;

the second contact group consists of four of the signal contacts arranged in the pitch direction;

the four signal contacts of the second contact group include two inner contacts located inward in the pitch direction and two outer contacts located outward in the pitch direction; and a size of the intersecting portion of each of the inner contacts in the pitch direction is larger than another size of the intersecting portion of each of the outer contacts in the pitch direction.

10. The connector as recited in claim 9, wherein a size of the intersecting portion of each of the signal contacts of the upper contacts in the pitch direction is equal to another size of the intersecting portion of each of the outer contacts of the second contact group in the pitch direction.

11. The connector as recited in claim 1, wherein the fixed portions of the contacts are fixed to the circuit board via surface mount technology (SMT) or through hole technology (THT) when the connector is used.

12. A connector mountable on a circuit board and mateable with a mating connector along a mating direction, wherein:

the connector comprises a housing and a plurality of contacts which include two or more signal contacts for signal transmission and two or more predetermined contacts maintained at predetermined voltage levels;

the housing holds the contacts;

each of the contacts has a horizontal portion extending along the mating direction, an intersecting portion extending along an intersecting direction intersecting with the mating direction, a fixed portion extending from the intersecting portion and fixed to the circuit board when the connector is used, and a coupling portion coupling the horizontal portion and the intersecting portion to each other;

the contacts include one or more first contact groups;

each of the first contact groups consists of two of the predetermined contacts and one differential pair of two of the signal contacts;

for each of the first contact groups, the contacts are arranged in a pitch direction perpendicular to the mating direction, and the differential pair is located between the predetermined contacts in the pitch direction;

for each of the first contact groups, a size of the coupling portion of each of the predetermined contacts in the pitch direction is larger than another size of the coupling portion of each of the signal contacts in the pitch direction, and a size of the intersecting portion of each of the predetermined contacts in the pitch direction is larger than another size of the intersecting portion of each of the signal contacts in the pitch direction;

the contacts include two or more of the first contact groups;

the contacts of the two or more of the first contact groups are arranged in the pitch direction; and for each of the first contact groups, a distance between the intersecting portion of one of the signal contacts and the intersecting portion of the predetermined contact adjacent thereto in the pitch direction is longer than another distance between the intersecting portions of the two signal contacts in the pitch direction.

* * * * *